US007207284B2

(12) United States Patent
Smedal et al.

(10) Patent No.: US 7,207,284 B2
(45) Date of Patent: Apr. 24, 2007

(54) TANK INSTALLATION FOR THE STORAGE OF LIQUIDS

(75) Inventors: Arne Smedal, Faervik (NO); Kåre Syvertsen, Tveit (NO)

(73) Assignee: Sevan Marine AS, Tananger (NO)

( * ) Notice: Subject to any disclaimer, the term of this patent is extended or adjusted under 35 U.S.C. 154(b) by 0 days.

(21) Appl. No.: 10/548,649

(22) PCT Filed: Mar. 12, 2004

(86) PCT No.: PCT/NO2004/000068

§ 371 (c)(1),
(2), (4) Date: Nov. 15, 2005

(87) PCT Pub. No.: WO2004/080791

PCT Pub. Date: Sep. 23, 2004

(65) Prior Publication Data

US 2006/0147272 A1 Jul. 6, 2006

(30) Foreign Application Priority Data

Mar. 14, 2003 (NO) ..... 20031175

(51) Int. Cl.
*B65D 88/78* (2006.01)

(52) U.S. Cl. ..... 114/256; 114/125; 405/210

(58) Field of Classification Search ..... 114/74 A, 114/125, 256, 264, 266, 267; 405/195.1, 405/210, 224
See application file for complete search history.

(56) References Cited

U.S. PATENT DOCUMENTS

| | | | | |
|---|---|---|---|---|
| 2,631,558 | A * | 3/1953 | Harris | 114/256 |
| 3,145,680 | A | 8/1964 | Farkas et al. | |
| 3,327,667 | A * | 6/1967 | Manning | 114/256 |
| 3,472,032 | A * | 10/1969 | Howard | 405/210 |
| 3,708,987 | A * | 1/1973 | Roulet et al. | 405/210 |
| 3,811,460 | A | 5/1974 | Capdevielle et al. | |
| 3,921,558 | A * | 11/1975 | Redshaw | 114/256 |
| 3,939,790 | A | 2/1976 | Vargas et al. | |

FOREIGN PATENT DOCUMENTS

| | | |
|---|---|---|
| GB | 649302 A | 1/1951 |
| WO | WO 02/066316 A1 | 8/2002 |

* cited by examiner

*Primary Examiner*—Lars A. Olson
(74) *Attorney, Agent, or Firm*—Sughrue Mion, PLLC

(57) ABSTRACT

A tank installation for the storage of liquids, especially oil in a floating storage or production installation, including a number of tanks which are connected to pipe systems for supply of liquid to or removal of liquid from the tanks. The installation includes a central section around which the tanks are arranged in such a manner that each tank has an inner sidewall portion bordering on the central section, and the pipe systems are arranged in the central section and include radially extending pipe lengths that are connected to respective tanks.

8 Claims, 4 Drawing Sheets

TANK INSTALLATION FOR THE STORAGE OF LIQUIDS

Figure 1:
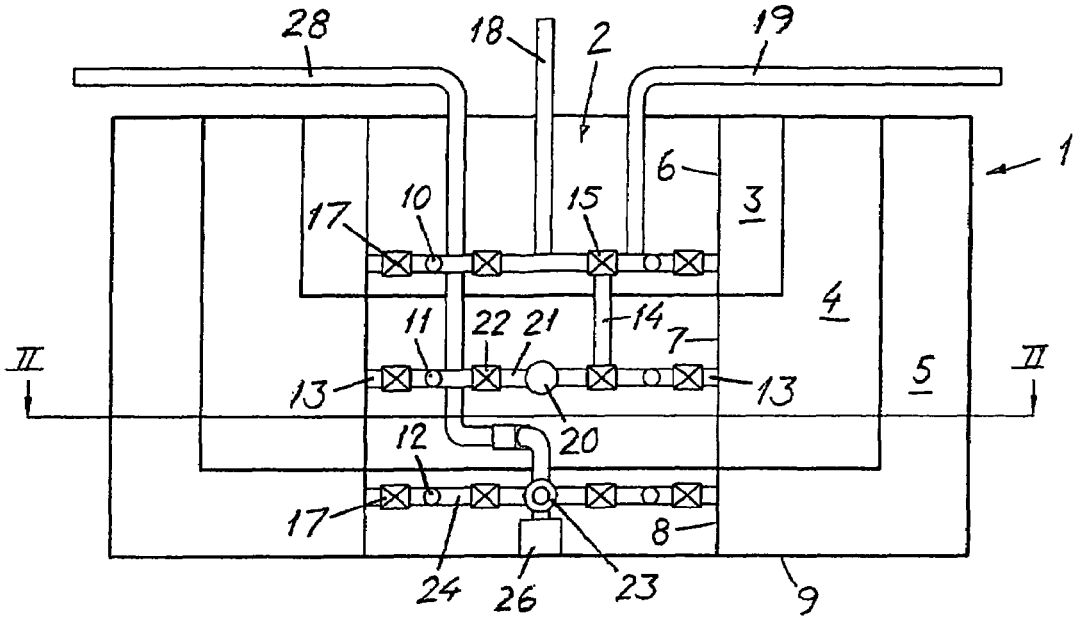

The invention relates to a tank installation for the storage of liquids, especially oil in a floating storage or production installation, comprising a number of tanks which are connected to pipe systems for supply of liquid to or removal of liquid from the tanks.

A floating production installation with a storage for produced hydrocarbons and ballast comprises a tank arrangement having several separate tanks. A pipe system connects each tank with a pump installation. There are separate pipes and pump installations for hydrocarbons and for ballast. The pump installation is used for emptying or redistributing stored hydrocarbons. A separate pump installation for ballast is used to fill, empty and redistribute ballast water. Existing production installations with a storage to a great extent are based on hulls having the shape of a ship. Ballast tanks will here typically be located along the sides of the ship and in a possible double bottom. Tanks for hydrocarbons will be distributed in an elongated centre section. With this structure there will be a comprehensive pipe arrangement in order to be able to serve all tanks. Each tank shall also have local valves at each pipe connection. These valves shall be able to be remotely operated.

Pipes and valve systems in such tank installations will require inspection and maintenance. For a ship in normal service this is a part of a normal routine with regular docking about every five years. For a floating production unit, the unit will be built for continues operation over a long time without docking. This entails that inspection and maintenance of pipes and valve systems must be carried out while the unit is in operation. Operations of this type notoriously are very expensive when they are carried out offshore.

U.S. Pat. No. 3,811,460 shows a tank structure for the storage of several different liquids, where the tank structure is divided into a number of tanks. In one embodiment the structure comprises a pipe system which is placed in a central position in the tank. The pipe lengths here extend coaxially and are connected to respective tanks.

A main object of the invention is to optimize the pipe systems connecting the tanks in a tank installation of the type in question, by making the pipe connections as short as possible to reduce manufacturing and installation costs.

Another object of the invention is to simplify and reduce the need for inspection and maintenance of the pipe systems in the operational phase.

For achieving the stated objects, there is provided a tank installation of the type stated in the introduction which, according to the invention, is characterised in that it comprises a central section around which the tanks are arranged in such a manner that each tank has an inner sidewall portion bordering on the central section, and that the pipe systems are arranged in the central section and comprise radially extending pipe lengths that are connected to respective tanks.

An advantageous embodiment of the tank installation according to the invention is characterised in that the tanks are arranged in several levels so that the inner sidewall portions of the tanks at the different levels lie above each other, and that the pipe systems include a ring conduit for each level of tanks, each ring conduit being connected to the tanks at the appurtenant level via short radially extending pipe lengths.

The tank arrangement according to the invention is arranged such that there will not be pipes or valves neither in tanks for hydrocarbons nor in ballast tanks. All tanks are placed so that they have a sidewall portion bordering inwards towards a space in the centre. This space is accessible for daily inspection and for simple access for maintenance. All valves will be placed in the central space. The pipe systems mainly are arranged in the central space, only with short pipes and suction pipe sockets into each individual tank.

The invention offers great savings both in the construction of the installation (shorter pipes and simpler arrangement) and in the operational phase. Inspection can be carried out simply and efficiently as all valves are placed in a readily accessible space. Maintenance of the pipe systems is reduced to a minimum since the length of pipes is considerably reduced. Possible repair or exchange is also simple, as the pipe systems mainly are located in an accessible area. In all, savings in the construction and operational phase will be considerable. The arrangement will also increase the security during operation, as a more efficient inspection and supervision is possible.

Figure 2:
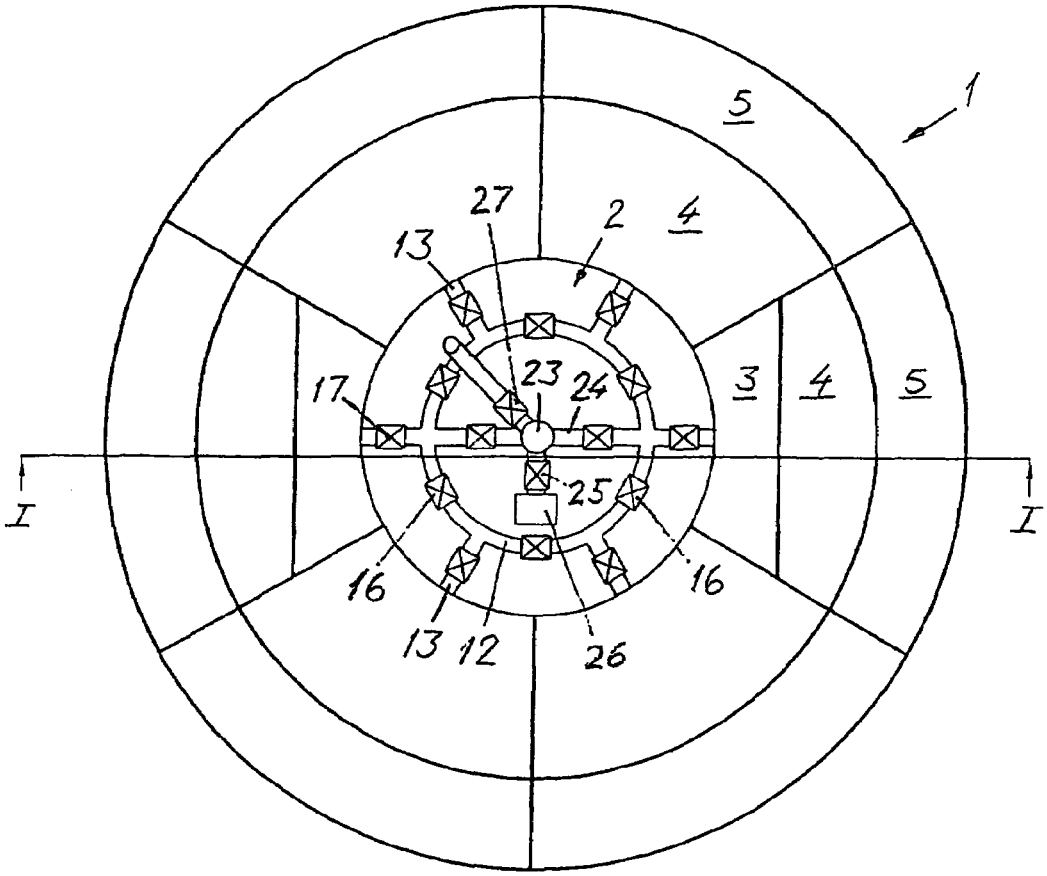
Figure 3:
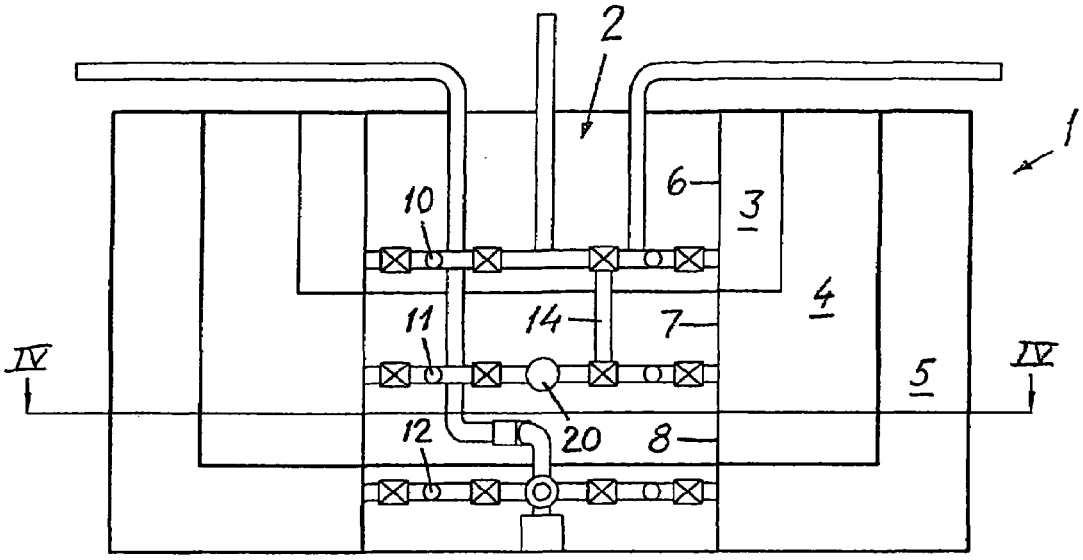
Figure 4:
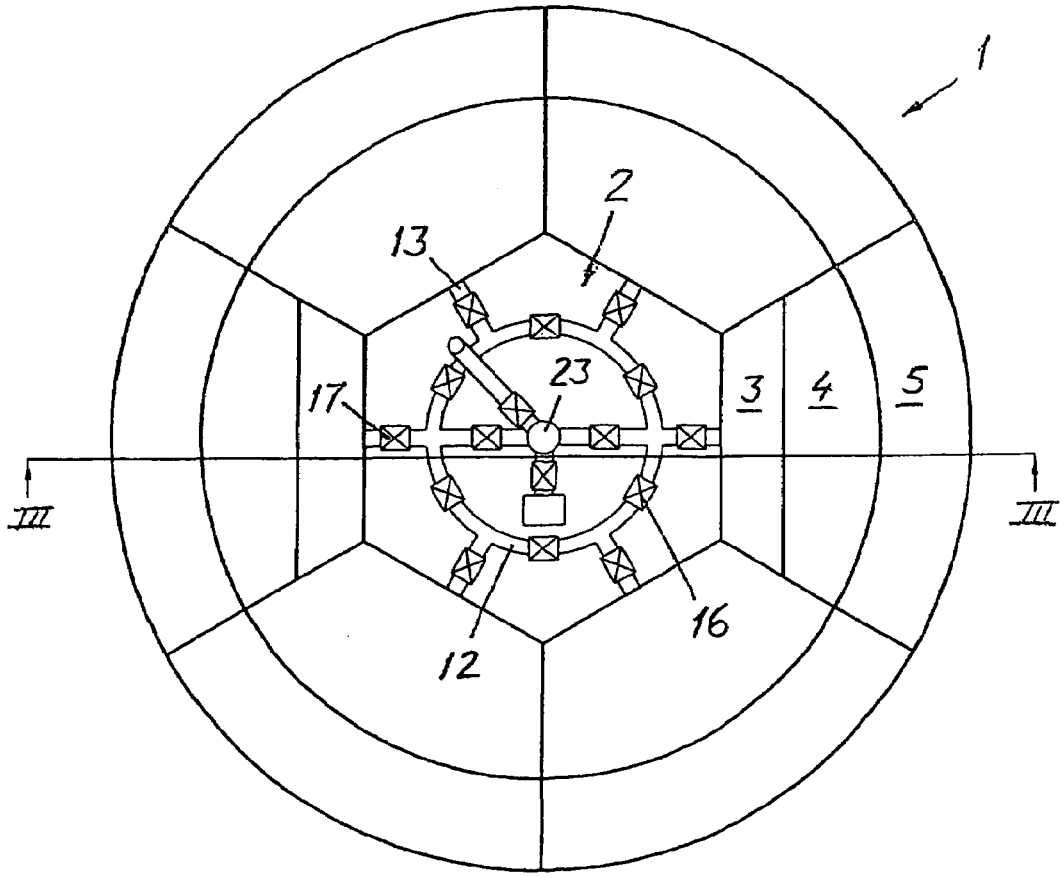

The invention will be further described below in connection with exemplary embodiments with reference to the drawings, wherein FIG. 1 shows a schematic sectional view of an installation according to the invention along the line I—I in FIG. 2;

FIG. 2 shows a plan view in a section along the line II—II in FIG. 1; and FIGS. 3 and 4, FIGS. 5 and 6 and FIGS. 7 and 8 show sectional views corresponding to those in FIGS. 1 and 2, and with similar pipe systems, but with different cross-sectional shapes of the central section and of the tanks in the installation.

Similar parts and elements are designated by the same reference numerals in the different figures.

In the embodiments shown in the drawings the tank installation according to the invention is constructed as a floating unit, more specifically as a unit for use as a floating storage or a floating installation or plant for the production of hydrocarbons, where demands are made on storage of liquids, such as ballast, crude oil, liquefied gas, etc. It will be clear, however, that such an installation may also be adapted and used for land-based operation.

As appears from FIGS. 1 and 2, the tank installation 1 comprises a central section 2 around which a number of tanks 3, 4, 5 are arranged in such a manner that each tank has an inner sidewall portion 6, 7, 8 bordering on the central section 2.

The central section 2 has full access, so that all equipment in the central section is accessible for inspection, maintenance and possible replacement. The pipe systems are arranged in the central section in an arrangement which is further described below.

In the illustrated embodiment, the tanks 3, 4, 5 are arranged in three levels, so that the inner sidewall portions 6, 7, 8 at the different levels lie above each other. This implies that the tanks beneath the uppermost tanks have a more or less L-shaped cross-section (in the radial direction), as appears from FIG. 1. As shown, the tank arrangement comprises six ballast tanks 5 arranged in mutually adjacent relation along the outer sides and the bottom 9 of the floating unit 1. Between the ballast tanks 5 and the centre section 2 there are placed a corresponding number of cargo or loading tanks 4 for oil or other dangerous load, and further a pair of diametrically opposite slop tanks 3 inside of respective ones of the tanks 4. Thus, the tanks 3 and 4 are protected by the surrounding ballast tanks 5.

The pipe systems include a horizontally extending ring conduit 10, 11, 12 for each tank level, and each ring conduit is connected to the tanks at an appurtenant level via short, radially extending pipe lengths 13. The two uppermost ring conduits 10 and 11 in the illustrated embodiment are connected to each other via a vertically extending pipe length 14, a closing or shut off valve 15 being arranged at each end of the pipe length. Each of the ring conduits 10, 11, 12 is provided with valves 16 between each of the radially extending pipe lengths 13, and also the radially extending pipe lengths are provided with respective valves 17, so that the desired parts of the pipe systems can be connected selectively with the desired tanks.

The uppermost ring conduit 10 is connected to a filling line 18 for the topical liquid, usually oil, and to a discharge line 19 for the liquid. By means of the vertical pipes 14 and the valves 15, and possibly also additional valves, also the middle ring conduit 11 can be connected to the filling and discharge lines 18 and 19, respectively.

As shown in FIG. 1, the ring conduit 11 is connected to a pump 20 placed centrally in the centre section 2, inside of the ring conduit. The pump 20 is connected to the ring conduit 11 via a pipe length 21 having an appurtenant valve 22.

The lowermost ring conduit 12 is arranged in connection with the ballast tanks 5 and is shown in plan view in FIG. 2. The ring conduit is connected to the appurtenant tanks in a corresponding manner to that of the remaining ring conduits. The ring conduit 12 further is connected to a centrally arranged pump 23 via appurtenant valved pipe lengths 24. The pump 23 is connected via a valve 25 to a so-called sea chest 26 communicating with the surrounding sea. Further, the pump is connected via an additional valve 27 to a discharge line 28 for ballast water. This arrangement enables a selective filling or emptying of the ballast tanks.

The embodiments of the tank installation shown in FIGS. 3–8, correspond to the embodiment according to FIGS. 1–2, apart from the shape of the limiting wall of the central section 2 and the shape of the outer circumference of the floating unit, and thereby the shape of the inside-lying tanks.

Thus, FIGS. 1 and 2 show a central section 2 where the inner sidewall portions of the tanks 3, 4, 5 are shaped such that the central section has a circular cross-section. As distinct from this, FIGS. 3–8 show embodiments wherein the inner sidewall portions of the tanks 3, 4, 5 are planar, so that the central section 2 has a polygonal, more specifically hexagonal, cross-section.

Figure 5:
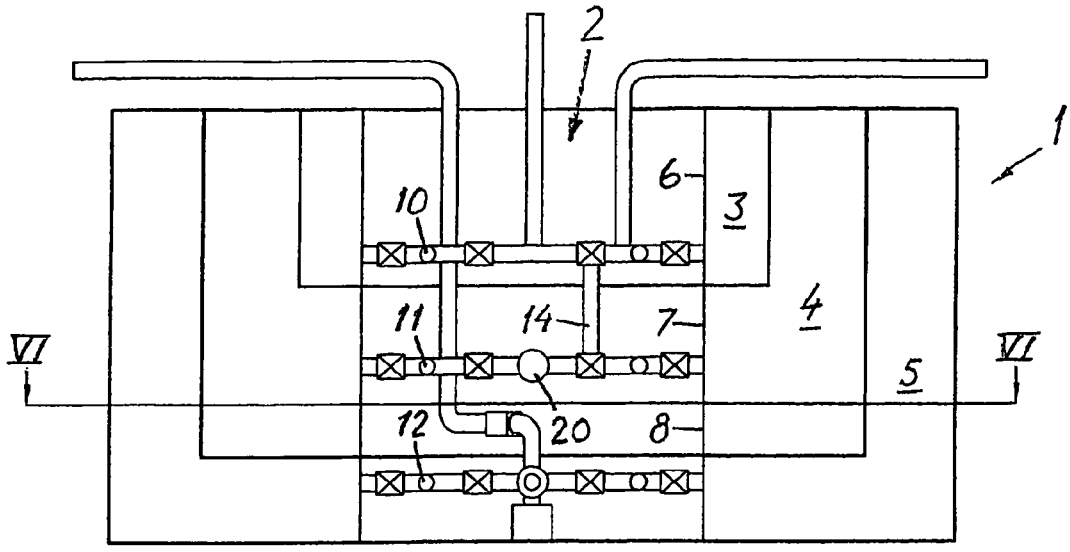
Figure 6:
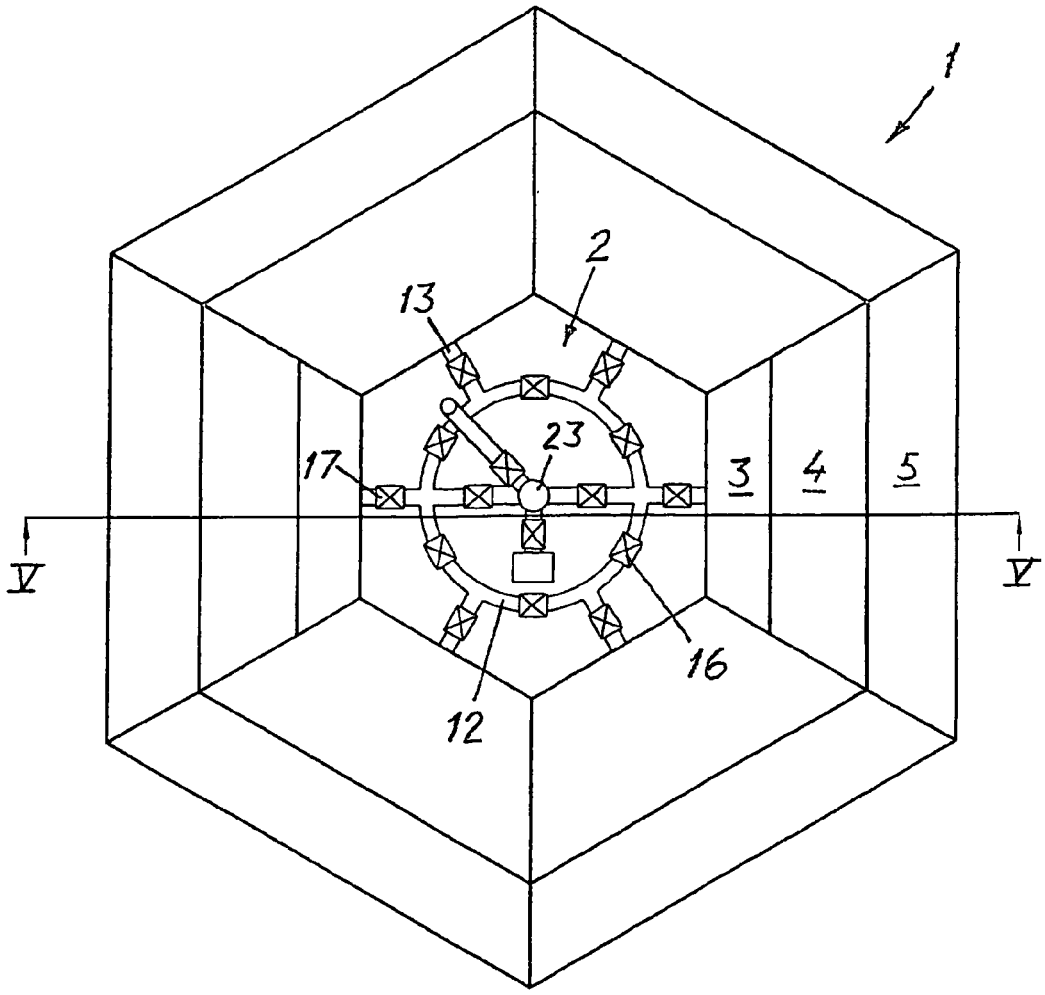
Figure 7:
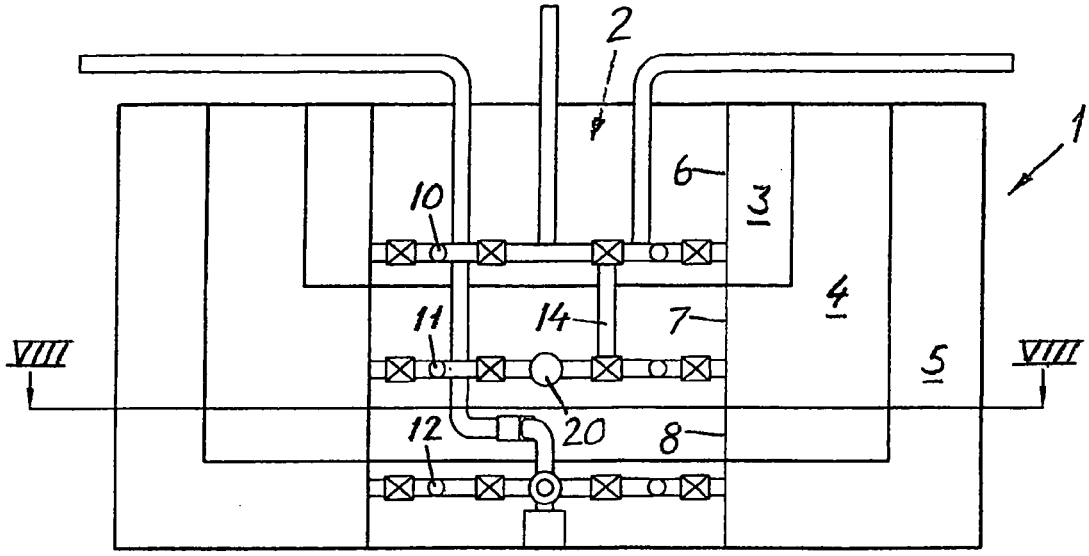
Figure 8:
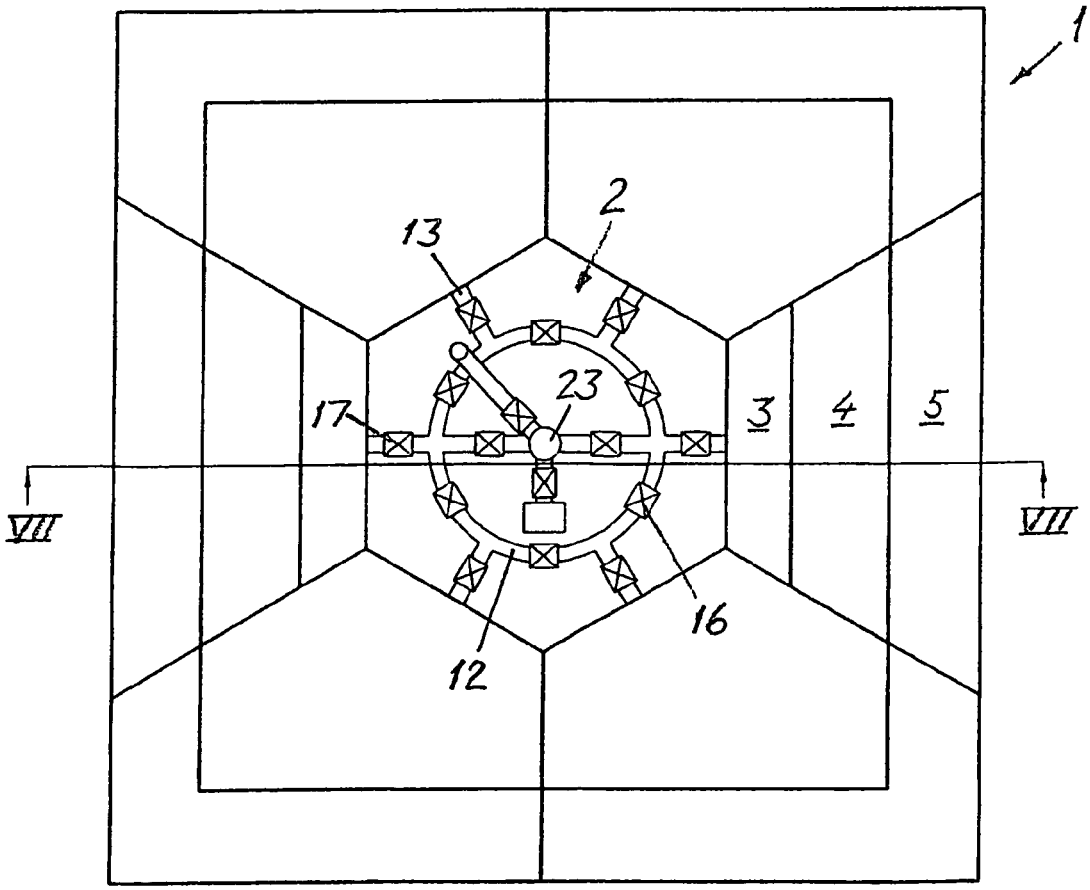

As regards the outer circumferential shape of the floating unit 1, the ballast tanks 5 in the embodiments according to FIGS. 1–2 and FIGS. 3–4 are designed with curved outer and inner walls, so that the floating unit 1 has a circular cross-section. In the embodiment of FIGS. 5 and 6, the ballast tanks 5 have planar inner and outer walls which are parallel to the corresponding wall portions of the central section 2, so that the unit 1 has a hexagonal cross-section. In the embodiment of FIGS. 7 and 8, four of the ballast tanks are designed with a pair of mutually perpendicular portions, so that the floating unit 1 as a whole has a square cross-section.

Thus, in the illustrated embodiments, the floating unit 1 is a cylindrical or parallel-epipedic body where the central section 2 is placed essentially concentrically in the body and extends coaxially therethrough.

The invention claimed is:

1. A tank installation for the storage of liquids, comprising a number of tanks which are connected to pipe systems for supply of liquid to or removal of liquid from the tanks, wherein the tank installation comprises a central section around which the tanks are arranged in such a manner that each tank has an inner sidewall portion bordering on the central section, and wherein the pipe systems are arranged in the central section and comprise radially extending pipe lengths that are connected to respective tanks, further wherein the tanks are arranged in several levels such that the inner sidewall portions of the tanks at the different levels lie above each other, and wherein the pipe systems include a ring conduit for each level of tanks, each ring conduit being connected to the tanks at the appurtenant level via short radially extending pipe lengths.

2. A tank installation according to claim 1, wherein at least two ring conduits are connected to each other via a vertically extending pipe length.

3. A tank installation according to claim 2, wherein the ring conduits are connected to the vertically extending pipe length via valves at the ends thereof.

4. A tank installation according to claim 1, wherein the ring conduits are provided with valves between each of the radially extending pipe lengths, and also the radially extending pipe lengths are provided with valves.

5. A tank installation according to claim 1, wherein some of the ring conduits are arranged to be connected with a filling line and with a discharge line for the liquid in question.

6. A tank installation according to claim 1, wherein at least some of the ring conduits are connected to an appurtenant pump.

7. A tank installation according to claim 1, wherein the installation is constructed as a floating unit, wherein the unit includes a number of ballast tanks arranged along the outer walls and the bottom of the unit, so that they have a generally L-shaped cross-section, the ring conduit at the bottom of the central section being connected to the ballast tanks via respective radially extending pipe lengths, and further is connected to a pump which may be connected alternatively to a sea chest at the bottom of the unit, or to a discharge line for ballast water.

8. A tank installation according to claim 1, wherein said liquids comprise oil in one of a floating storage and production installation.

* * * * *